United States Patent [19]

Matsumura et al.

[11] 4,311,110

[45] Jan. 19, 1982

[54] ELECTROSTATIC PHOTOCOPYING APPARATUS WITH IMPROVED DEVELOPER SUPPLY MEANS

[75] Inventors: Kenichi Matsumura, Yamatokoriyama; Shinichi Mizuguchi, Katano; Tadayuki Onoda; Tsutomu Hamada, both of Neyagawa; Hisato Noda, Kadoma, all of Japan

[73] Assignee: Matsushita Electric Industrial Co., Ltd., Kadoma, Japan

[21] Appl. No.: 136,071

[22] Filed: Mar. 28, 1980

[30] Foreign Application Priority Data

Mar. 30, 1979 [JP] Japan ..... 54-38756
Mar. 30, 1979 [JP] Japan ..... 54-38757

[51] Int. Cl.[3] ..... G03G 15/08

[52] U.S. Cl. ..... 118/50.1; 118/57; 118/647; 118/652; 118/653; 355/3 DD

[58] Field of Search ..... 118/648, 652, 647, 655, 118/653, 50.1, 57; 355/3 DD; 430/103

[56] References Cited

U.S. PATENT DOCUMENTS 2,880,699 4/1959 Hayford ..... 430/103 X
3,132,962 5/1964 Seymour ..... 118/647 X
3,807,997 4/1974 Cade et al. ..... 118/655 X

*Primary Examiner*—Evan K. Lawrence
*Attorney, Agent, or Firm*—Wenderoth, Lind & Ponack

[57] ABSTRACT

An electrostatic photocopying apparatus has a charger adjacent to a photosensitive body, a retaining means for retaining and supplying image forming particles to the photosensitive body, a particle supply means for supplying the particles to the retaining means, and a single-layer producing means for applying to the image forming particles forces which are not sufficient to remove from the photosensitive body the image forming particles adhered directly to the photosensitive body, but are sufficient to remove the image forming particles attached in the second or higher layer thereover. The image forming particles can be evenly spread in one layer on the photosensitive body. Even if the photosensitive body is carried at high speed, the spreading operation can be carried out correspondingly. In addition, the starting and stopping of the spreading of the image forming particles can be easily performed and the amount of the image forming particles used can be reduced. In one embodiment, the retaining means is a multistylus electrode.

4 Claims, 5 Drawing Figures

ELECTROSTATIC PHOTOCOPYING APPARATUS WITH IMPROVED DEVELOPER SUPPLY MEANS

The present invention relates to an electrostatic type photocopying apparatus and, more particularly, to improvements in an image forming particle supply device for use in an electrostatic photocopying apparatus.

FIG. 1 shows a conventional system employing a scattering device for electrostatically adhering image forming particles to the surface of a photosensitive body. Referring to FIG. 1, when a photosensitive body b has been charged electrostatically by a charger a, the gate d of a hopper c is opened by a known means so as to cause image forming particles e to flow onto the photosensitive body b. However, it is to be noted that in such a case, a large amount of image forming particles are required to be discharged from the gate d in order to closely adhere the image forming particles to the photosensitive body b. Most of the image forming particles discharged from the gate d are recovered in a recovering container f provided a little below the hopper c, and excess image forming particles are thus transferred from the hopper to the container. Also, as the speed of the photosensitive body b becomes higher, the capacity of the device to spread the particles on the photosensitive body is considerably reduced. To reduce the amount of the image forming particles used, a method has been proposed to return the image forming particles which have been recovered in the container f to the hopper c by a circulating means, In such an arrangement, the image forming particles recirculated are often damaged rapidly, since the image forming particles are stirred by the circulating means, and the light permeability and conductive property of the image forming particles are suddenly caused to deteriorate, thus causing foggy images in the developing operation.

Accordingly, a principal object of the present invention is to provide a supply device for use in an electrostatic photocopying apparatus which can cause the image forming particles closely to adhere to the photosensitive body, can supply the image forming particles without damaging them and can spread the particles sufficiently even if the speed of the photosensitive body becomes higher.

Another object of the present invention is to provide a supply device which is particularly effective in an electrostatic photocopying apparatus, wherein image forming particles are electrostatically adhered to the surface of the photosensitive body containing photoconductive materials, an image exposing operation is carried out on the photosensitive face of the photosensitive body with the image forming particles thereon to reduce or remove the electrostatic charge in the light irradiated regions on the photosensitive face, the image forming particles as to which the electrostatic attraction between the photosensitive face and the particles has been reduced or removed, are removed from the photosensitive body thereby to leave images defined by the particles remaining on the photosensitive body.

A further object of the present invention is to provide a supply device which can reduce the amount of the image forming particles used.

According to the present invention, there is provided a supply device for use in an electrostatic photocopying apparatus in which image forming particles have been uniformly spread on photosensitive body containing photoconductive materials and charged by a charger and thereafter exposing and developing operations are performed on the photosensitive body, said device comprising a retaining means for said image forming particles which are close to or in partial contact with said photosensitive body, a particle supply means for supplying the particles to said retaining means, and a single-layer producing means adapted to apply to said image forming particles forces which are not sufficient to remove from the photosensitive body the image forming particles adhered directly to said photosensitive body, but are sufficient to remove the image forming particles adhered in a second or greater layer over said directly adhered particles; said charger, retaining means and single-layer producing means being disposed in order along the path of movement of the photosensitive body in the direction of movement of said photosensitive body.

These and other objects, features, aspects and advantages of the present invention will become more apparent from the following detailed description of the present invention when taken in conjunction with the accompanying drawings, in which.

Figure 1:
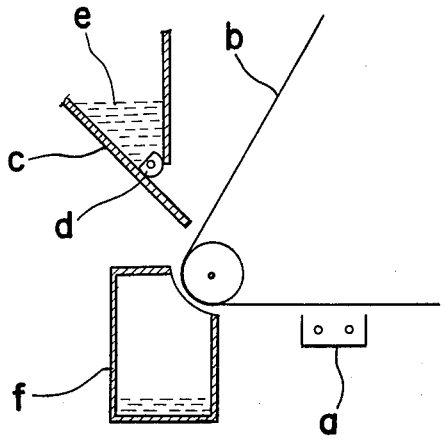
FIG. 1 is a schematic view of the construction of a conventional electrostatic type photocopying apparatus as described above.
Figure 2:
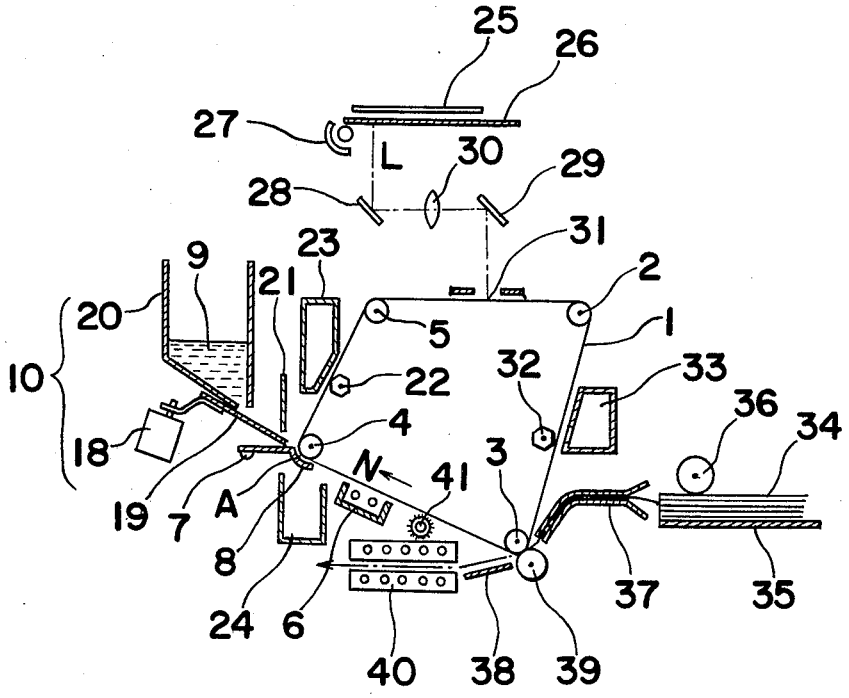
FIG. 2 is a schematic view showing the construction of one embodiment of an electrostatic photocopying apparatus according to the present invention.
Figure 3:
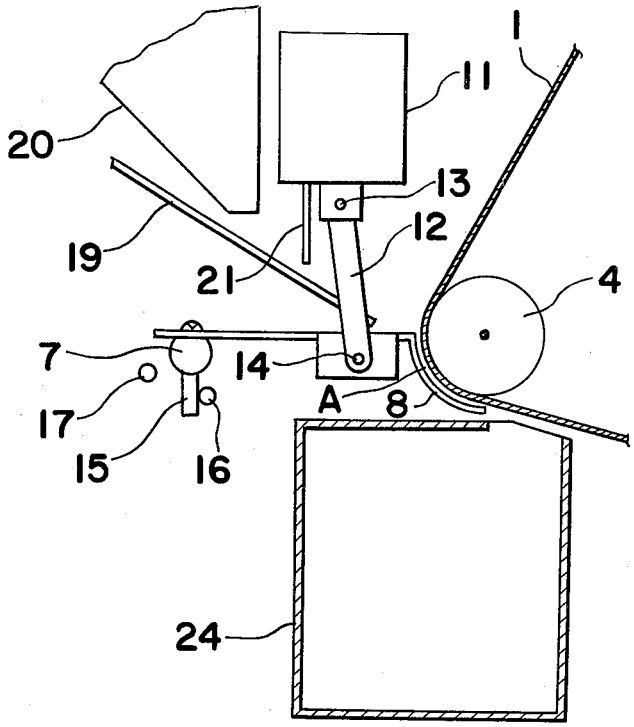
FIG. 3 is a schematic elevation view, on an enlarged scale and partly in section, showing the construction of a supply device for image forming particles for use in the apparatus of FIG. 2.

In the first embodiment of the present invention, the apparatus comprises, as shown in FIGS. 2 and 3, a photosensitive body 1 transported along a path of movement past a charger 6, an image forming particle supply device, including retaining means 8 for retaining the particles to be adhered to the photosensitive body 1 in close contact with the body 1, particle supply means 10 for supplying the particles to the retaining means 8 and a single-layer producing means adapted to reform the image forming particles into one layer on said photosensitive body, an optical system including a transparent support unit 26, a developing unit, a copying sheet supplying unit, a fixing unit, a cleaning unit, and control unit for operating the above units in order to transfer the image to be copied onto the copying sheet by the image forming particles carried on the photosensitive body 1.

Referring to FIG. 2, the photosensitive body 1 containing photoconductive materials is a belt-shaped or ribbon-shaped sheet which is supported and transported under tension along the path of movement thereof by a driving roller 2 and plural guide rollers 3, 4, and 5 in a known manner. The supply device for image forming particles is disposed adjacent the path of movement of the photosensitive body 1 subsequent, in the direction of movement, to the charger 6 provided below the photosensitive body 1. The charger 6 is energized to charge the front face of the photosensitive body 1 with an electrostatic charge. The supply device A is composed of a retaining means 8 which is rotatably mounted on a shaft 7 on a side plate (not shown) of the apparatus and is a lever provided with a concavely curved portion at the free end thereof for receiving image forming particles to be electrostatically adhered to the photosensitive body 1, a driving means including a solenoid for rotating the retaining means 8 towards the photosensitive body 1, and a supplying means 10 provided above the retaining means 8 for supplying the image forming particles 9 onto the retaining means 8. The single-layer producing means is disposed subsequent relative to the running direction of the photosensitive body 1, to the retaining means 8 and is adapted to reform the multilayers of the image forming particles adhered to the photosensitive body 1 by the operation of the supply device into one layer of the image forming particles disposed on the photosensitive body 1 as described later.

As shown in FIG. 3, the retaining means 8 is fixedly mounted on the shaft 7 at one end thereof with the concavely curved portion 8*a* at the other end and is connected at its intermediate portion through a lever to a solenoid 11 secured on a side plate (not shown) of the apparatus. The shaft 7 is rotatably mounted on the side plate (not shown) of the apparatus and the lever 12 is pivotally connected to the solenoid 11 and the intermediate portion of the retaining means 8 by pins 13 and 14, respectively. The retaining means 8 is operated by the actuation of the solenoid 11 through the lever 12 to rotate the concavely curved portions around the shaft towards the electrostatically charged front face of the photosensitive body. The shaft 7 of the retaining means 8 is provided with a positioning pin 15 which is adapted to engage a stop 16 extended from the side plate (not shown) of the apparatus to set the stationary position of the retaining means 8 during the spreading of the image forming particles 9. When the positioning pin 15 on the shaft 7 rotates with the retaining means 8 as the retaining means moves away from the body 1 under the effect of the solenoid 11, it hits a stop 17 to stop the retaining means 8 in a position where the electrostatic force of the photosensitive body 1 does not reach the image forming particles on the concavely curved portion of the retaining means 8.

After the image forming region of the photosensitive body 1 has been charged by the charger 6, the solenoid 11 is energized only when the image forming region of the photosensitive body 1 passes the supply device A. When the retaining means 8 is rotated by the solenoid 11 during movement of the photosensitive body 1, the concavely curved portion of the retaining means 8 may come into contact with the image forming region of the photosensitive body 1 so that the image forming particles are transferred from the retaining means 8 to the photosensitive body 1, thereby forming multiple layers of the image forming particles on the photosensitive body 1. The particle supply means 10 provided above the retaining means is composed of a vibration plate 19 having a vibrator 18 provided at one end, thereof, a hopper 20 for storing image forming particles 9 therein and a gate 21 provided at the outlet of the hopper 20 for adjusting the amount of the image forming particles supplied from the hopper 20 to the retaining means 8 along the vibration plate 19.

The single-layer producing means is provided along the path of movement of the photosensitive body 1 subsequent to the retaining means, and is composed of an exciting roller 22 having a hexagonal cross-section in contact with the back face of the photosensitive body 1 and a suction box 23 provided above the front face, i.e., the image forming region of the photosensitive body 1 in front of the exciting roller 22. The exciting roller 22 is driven so as to rotate by means of a motor (not shown) and tip or vibrate the photosensitive body 1, and the suction box 23 has a suction opening through which the extra image forming particles removed from the body 1 by the action of the exciting roller 22 on the body 1 are sucked into the suction box 23 by means of a compressor (not shown), thereby leaving only one uniform layer of the image forming particles on the photosensitive body 1. The operations of the photosensitive body 1, retaining means 8, supply means 10 and single-layer producing means are synchronized with each other by means of a control unit (not shown) so as to form the single uniform layer of the image forming particles on the photosensitive body 1. A container 24 is provided under the retaining means 8 for recovering image forming particles dropped from the retaining means 8.

The image forming particles 9 are micro-particles each being 5 to 50$\mu$ in diameter and a mixture of light-transmitting image-forming particles which contain sublimable colorless dye developing yellow and allowing blue purple light to be transmitted therethrough, light-transmitting image-forming particles which contain sublimable colorless dye developing magenta and allowing green light to be transmitted therethrough, and light-transmitting image-forming particles which contain sublimable colorless dye developing cyan and allowing red light to be transmitted therethrough.

A color manuscript 25 to be copied is disposed on the transparent support unit 26 of the apparatus in a known manner. An optical system is provided which is composed of the support unit 26, a light source 27, reflection mirrors 28 and 29, a lens 30 and a slit 31. Light supplied from the light source 27 is reflected by the color manuscript and applied to the photosensitive body 1 and the image forming particles passing under the slit 31 along the route shown by the one-dot broken line L, reflecting from the reflection mirrors 28 and 29 and passing through lens 30 to expose the image of the manuscript onto the particles. A developing unit for developing the exposed images of the particles on the photosensitive body 1 is composed of an exciting roller 32 and a suction box 33. The exciting roller 32 has at its outer periphery at least one extending projection which comes into contact with the reverse face of the photosensitive body 1, and is rotated by a rotary drive means (not shown). In this example, a hexagonal cross-section roller is used. The suction box 33 is provided with a suction opening facing the front face of the photosensitive body 1, and is connected with a suction source (not shown). A supply of image receiving sheets of copy paper 34 are accommodated in a paper supply tray 35. The topmost image receiving sheet is contacted by a feed out roller 36. Paper guides 37 and 38 are provided before and after a transfer roller 39. The transfer roller 39 presses the copy paper into contact, under a predetermined pressure, with the photosensitive body 1 to transfer the exposed image particles from the photosensitive body 1 to the copy paper sheet. A fixing unit including a heater 40 heats the image forming particles transferred onto the copy paper sheet to provide colored images of sublimable colorless dye, contained in the image forming particles, on the surface of the copy paper sheet. A cleaning unit including a rotary brush 41 removes image forming particles remaining on the photosensitive body 1 after the transfer operation.

To operate the apparatus having the above units, an operation first depresses a copy button (not shown) for the control unit, and the photosensitive body 1 starts to move in the direction of the arrow N and is electrostatically charged by the charger 6 in a known manner. As the image forming region of the charged photosensitive body 1 reaches the supply unit, the retaining means 8 is moved closer to the photosensitive body 1 as shown in FIG. 3. At the same time, the vibrator 18 operates to feed the image forming particles fed on the vibration plate 19 to the retaining means 8. Some of the image forming particles fed to the retaining means 8 drop into the recovery container 24. Most of the image forming particles are stored, in a thick layer, on the retaining means 8. Because the contact area between the photosensitive body 1 and the image forming particles stored on the retaining means 8 is large, the image forming particles adhere closely to the photosensitive body 1 to form multiple layers of the image forming particles upon the photosensitive body 1 even if the photosensitive body 1 runs at high speed. After the multiple layers of image forming particles are adhered to the photosensitive body 1 in the supply unit A, the exciting roller 22 hits the reverse face of the photosensitive body 1 and vibrates it so as to apply to the image forming particles a force sufficient to remove the particles in the layers other than the layer directly on the body 1, but not sufficient to remove the image forming particles in the single layer adhered directly to the photosensitive body 1. Thus, the image forming particles are provided in a single uniform layer upon the front face of the photosensitive body 1. The exciting roller 22 has an axially extending projection at least at one position as does the exciting roller 32 so that at least the projection will come into contact with the reverse face of the photosensitive body 1. In this example, a hexagonal cross-section roller is used. The image forming particles removed here are drawn into the suction box 23.

The image forming region of the photosensitive body 1 on which a single layer of image forming particles is adhered by the single-layer producing unit is irradiated at the position of the slit 31 by directing light from the slit onto the image forming particles and the photosensitive body 1. Light having colors corresponding to the colors of the manuscript passes through the image forming particles on the photosensitive body 1. The region of the photosensitive body with image forming particles through which the light has passed adhered thereon has the electrostatic charge thereof reduced or removed. Then, the image forming particles the electrostatic attraction between the photosensitive body 1 and the particles of which has been reduced or removed are removed from the photosensitive body 1 by the developing means in which the exciting roller 32 is operated to hit the reverse face of the photosensitive body and vibrate the body to remove the image forming particles having a reduced electrostatic charge. The remaining particles form the images of the color manuscript 25 on the photosensitive body 1. Then, the images formed by the residual particles are transferred from the photosensitive body 1 onto the copy paper sheet 34 by the transfer roller 39. The copy paper sheet 34 as to which the transfer operation is completed is carried to the fixing unit 40 to develop the color images from the sublimable colorless dye contained in the image forming particles.

Figure 4:
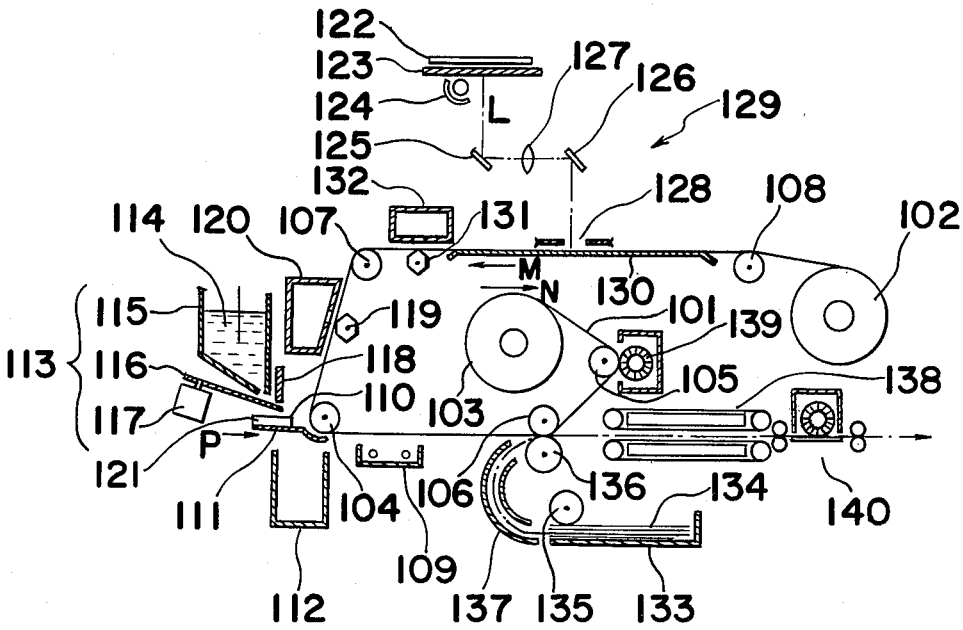
FIG. 4 is a schematic view showing the construction of another embodiment of an electrostatic photocopying appartus according to the present invention.

FIG. 4 is a schematic view of another embodiment of a color of electrostatic photocopying apparatus according to the present invention. The photosensitive body 101 is a sheet of paper supplied from a supply roll 102 and wound around a take-up roller 103 during the exposing process and, vice versa for the transferring process as described later. The photosensitive body 101 fed from the supply roll 102 is supported under tension by a driving roller 104 and guide rollers 105, 106, 107 and 108 in a known manner. The photosensitive body 101 is uniformly charged electrostatically by, at first, a charger 109. A supply unit for image forming particles is composed of a multistylus electrode 110 which acts as a discharge electrode for spreading the image forming particles into a uniform layer by the discharging force, a guide plate 111 for receiving and guiding image forming particles onto the photosensitive body 101, a means 113 for supplying the image forming particles to the multistylus electrode 110, a single-layer producing means for producing a single layer of the image forming particles which have been spread on the photosensitive body 101 by the multistylus electrode 110, and a recovering container 112 for receiving the image forming particles which fall from the guide plate 111. The multistylus electrode 110 and the guide plate 111 form a retaining means for image forming particles which corresponds to the retaining means 8 of the first embodiment of FIGS. 2 and 3. A supply means 113 is composed of a hopper 115 with image forming particles 114 stored therein, a vibrating plate 116, the image forming particles being fed to the multistylus electrode 110 by vibrating the plate which is inclined at an angle at which the image forming particles will normally not slide down, a vibrator 117 for vibrating the vibrating plate 116 and a gate 118 spaced at a predetermined distance from the vibrating plate 116 to adjust the amount of the image forming particles supplied from the hopper 115 to the multistylus electrodes 110.

The angle of inclination of the vibrating plate 16 depends on the fluidity of the image forming particles and is usually between 5° to 45°. The single-layer producing means is composed of an exciting roller 119 and suction box 120 which correspond to the elements 21 and 22 of the first embodiment of FIGS. 2 and 3.

Figure 5:
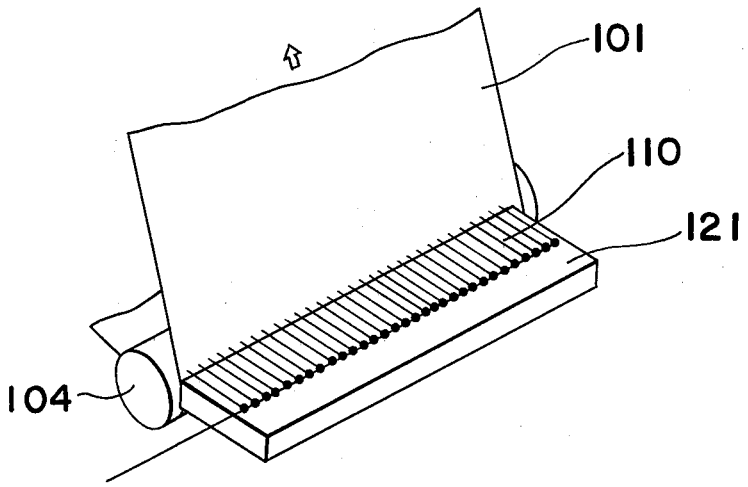
FIG. 5 is a perspective view of an essential portion of the apparatus of FIG. 4.

The multistylus electrode 110 which acts as the discharge electrode is provided at a position opposed to, at a predetermined distance, the photosensitive body 101, as shown in FIG. 5, and is bonded to an electrically insulating substrate 121. The tip ends of the electrode element of the multistylus electrode are aligned in a row with a constant clearance between the tip ends and the front face of the photosensitive body 101 and the other ends thereof are connected in parallel to an electric power supply (not shown) such as a battery for supply direct current. In this embodiment, the multistylus electrode has stylus-like electrode elements of wire 60$\mu$ in diameter and 8 dots per mm, that is, a pitch of 125$\mu$. A voltage which is opposite in polarity to the electric charge given to the photosensitive body 101 by the charger 109 is applied to the multistylus electrode 110. Once a voltage is applied to the multistylus electrode 110, corona ion current is generated between the photosensitive body 101 and the tip ends of the electrode elements of the multi-stylus electrode to spread the image forming particles uniformly on the photosensitive body 101. Since the image forming particles are charged with a polarity opposite to the electric charge on the photosensitive body 101 by the multistylus electrode 110, the image forming particles are adhered to the photosensitive body 101 and can be spread uniformly even if the photosensitive body 101 is transported at high speed. In addition, since the multistylus electrode 110 has the elements at a pitch as small as 125μ, all the particles are immediately charged even if each of the image forming particles is as small as 5μ to 50μ in diameter and the corona ion current is uniform in the width direction of the photosensitive body 101, thus ensuring even spreading. The electrode density of the multistylus electrode is not always required to be 8 dot per mm, and a uniform corona ion current can be achieved with higher electrode density.

The guide plate 111 is positioned under the insulating substrate 121 holding the multistylus electrode 110 thereon and close to or in partial contact with the photosensitive body 101 so as to stop or slow down the flow of the image forming particles fed from the vibrating plate 116. By this means, the rate of adherence of the image forming particles to the photosensitive body 101 is improved, the amount of the image forming particles used is reduced and the voltage applied to the multistylus electrode 110 is reduced. The guide plate 111 produces these effects as described hereinabove, but is not necessarily required as a particle remaining means since the multistylus electrode 110 only can spread the particles sufficiently. The voltage impressed upon the multistylus electrode 110 depends upon the clearance between the multistylus electrode and the photosensitive body 101. When the clearance is 1 mm, 500 V to 1 KV is proper when no guide plate 111 is provided, and 100 V to 1 KV is proper when the guide plate is provided.

A color manuscript 122 to be copied is disposed on a transparent support unit 123. An optical system 129 is provided which is composed of the support unit 123, a light source 124, reflection mirrors 125, and 126, a lens 127 and a slit 128. Light supplied from the light source 124 is reflected from the color manuscript 122 and is directed onto the photosensitive body 101 and the image forming particles along a path shown by one-dot broken line L which reflects from the mirrors and passes through the lens and slit to expose the particles on the photosensitive body 101. In this embodiment, a guide 130 is disposed against and in contact with the reverse face of the photosensitive body 101, and is positioned opposite the slit 128. The guide 130 hold the photosensitive body 101 level during the exposing operation and prevents the vibration occurring in the following developing process from being transmitted to the photosensitive body 101 located in the exposing unit.

The photosensitive body 1 transported in the direction of the arrow N for the exposing process completes the exposing process and then is transported in the other direction, i.e. the direction of an arrow M, to complete the process of transferring the particles from the photosensitive body 101 to the image receiving sheet of copy paper 134. The developing apparatus includes an exciting roller 131, which contacts the reverse face of the photosensitive body 101, and a suction box 132 which corresponds to the suction box 33 of the first embodiment of FIGS. 2 and 3. The exciting roller 131 can have the same shape as the exciting roller 119 for the single-layer producing means and operates in the same manner as the roller 32 of the first embodiment of FIGS. 2 and 3.

Image receiving sheets of copy paper 134 are stacked in the paper supply cassette 133 and the topmost image receiving sheet of copy paper contacts the feed out roller 135. A paper supply guide 137 is positioned between a transfer roller 136, which presses the copy paper against the photosensitive body 101 under a predetermined pressure, and the paper feed cassette 133 to facilitate the transportation of the image receiving sheet 134. A fixing unit 138 heats the image forming particles transferred onto the image receiving sheet of copy paper by the transfer roller 136 to develop the colored images of sublimable colorless dye contained in the image forming particles on the surface of the image receiving sheet of copy paper 134. Any image forming particles remaining on the photosensitive body after the transfer operation are removed by a cleaning unit 139 and the image forming particles remaining after the sublimation of the sublimable colorless dye attached on the image receiving sheet are removed by the cleaning apparatus 140.

In the above embodiment, the single-layer producing means is composed of an exciting roller 19 and a suction box 20, but the suction box is not always required. The image forming particles removed from the photosensitive body 1 by the exciting roller 19 may be caused to fall along the inclined face formed by the photosensitive body 1. Also, as another mechanism for one-layer producing means there can be used a system where a stream of gas is applied to the image forming particles to produce the single layer.

As described hereinabove, in the electrostatic photocopying apparatus of the present invention, the image forming particles can be evenly spread in a single layer on the photosensitive body, and even if the photosensitive body is carried at high speed, the spreading of the image forming particles can be carried out sufficiently well and the start and stop of the spreading of the image forming particles can be easily performed and the amount of the image forming particles used can be reduced.

Although the present invention has been described and illustrated in detail, it is to be clearly understood that the same is by way of limitation, the spirit and scope of the present invention being limited only by the terms of the appended claims.

What is claimed is:

1. An electrostatic photocopying apparatus comprising:

a photosensitive body having a photoconductive material thereon;

means for transporting said body along a path;

A supply device positioned along said path for uniformly covering said body with image forming particles which are to be subsequently exposed and then developed, said supply device having a multistylus electrode including a plurality of stylus-like electode elements supported in position with the tips of the respective electrode elements positioned adjacent the body and across the body in the width direction of the body, means for applying to said electrode a voltage of a polarity opposite to the polarity of the charge on said body for causing the image forming particles to adhere to said body, means for supplying the image forming particles to the multi-stylus electrode; and a singlelayer producing means positioned along said path subsequent to the multi-stylus electrode in the direction of transportation of the body for removing from the body the image forming particles which do not directly contact the body thereby leaving only a single layer of particles.

2. An apparatus as claimed in claim 1, wherein said singlelayer producing means comprises a rotary means for repeatedly engaging the photosensitive body for shaking loose the extra image forming particles transferred thereto by the multi-stylus electrode for leaving only one layer of the image forming particles on the photosensitive body, and a suction means for collecting the image forming particles shaken loose from the photosensitive body by said rotary means.

3. An apparatus as claimed in claim 2, wherein said photosensitive body is a ribbon-shaped sheet, said rotary means is a roller having at least one projection thereon extending in the axial direction thereof for contacting the face of said body on the opposite side from the side with photosensitive body particles adhered thereto, and said suction means is a suction box being on the side of the photosensitive body opposite to said roller.

4. An apparatus as claimed in claim 1, wherein said supply device further has a guide plate positioned under said electrode and extending to said body for stopping or slowing the flow of said image forming particles to said photosensitive body.

* * * * *